United States Patent [19]

Bakken

[11] 4,379,560

[45] Apr. 12, 1983

[54] TURBINE SEAL

[75] Inventor: Gordon J. Bakken, Plymouth, Mass.

[73] Assignee: Fern Engineering, Bourne, Mass.

[21] Appl. No.: 292,688

[22] Filed: Aug. 13, 1981

[51] Int. Cl.[3] ..... F01D 11/00; F02C 07/28

[52] U.S. Cl. ..... 277/236; 415/135; 415/136

[58] Field of Search ..... 415/138, 134, 135, 136; 277/236, 53–57

[56] References Cited

U.S. PATENT DOCUMENTS

| | | | |
|---|---|---|---|
| 1,073,916 | 9/1913 | Ljungstrom | 415/135 |
| 1,807,460 | 5/1931 | Wiberg | 277/57 |
| 2,919,891 | 1/1960 | Oliver | 415/136 |
| 3,056,615 | 10/1962 | Breitenstein | 285/187 |
| 3,398,978 | 8/1968 | Gasche | 285/187 |
| 3,458,207 | 7/1969 | Conti | 277/83 |
| 3,645,092 | 2/1972 | Tatsutomi et al. | 60/29 |
| 3,704,034 | 11/1972 | Shire | 285/47 |
| 3,771,798 | 11/1973 | McDonald | 277/236 |
| 3,889,958 | 6/1975 | Bennett | 277/24 |
| 4,063,845 | 12/1977 | Allen | 277/236 |
| 4,072,327 | 2/1978 | Young | 285/137 |
| 4,188,037 | 2/1980 | Abbes et al. | 277/236 |

FOREIGN PATENT DOCUMENTS

| | | | |
|---|---|---|---|
| 1534660 | 12/1978 | United Kingdom | 415/135 |

OTHER PUBLICATIONS

German Publication "Construction in Steam Turbine Building" of A. Loschge, 1955.

*Primary Examiner*—Robert I. Smith

*Attorney, Agent, or Firm*—Norman S. Blodgett; Gerry A. Blodgett

[57] ABSTRACT

Seal for two concentric tubular elements of a gas turbine, consisting of rings associated with each element and having facing grooves, and of a connector extending between the grooves and consisting of two annuli which are in concentric spaced relationship and are joined by a web.

3 Claims, 5 Drawing Figures

FIG. 2
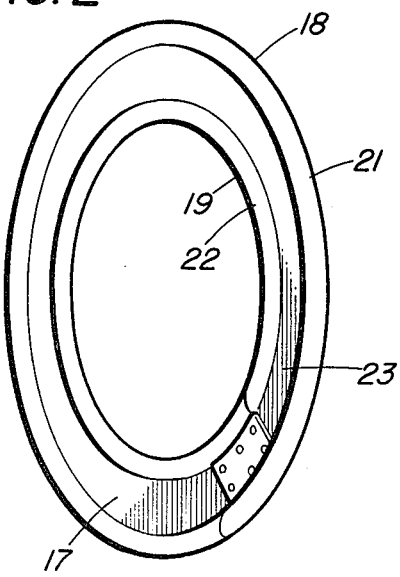
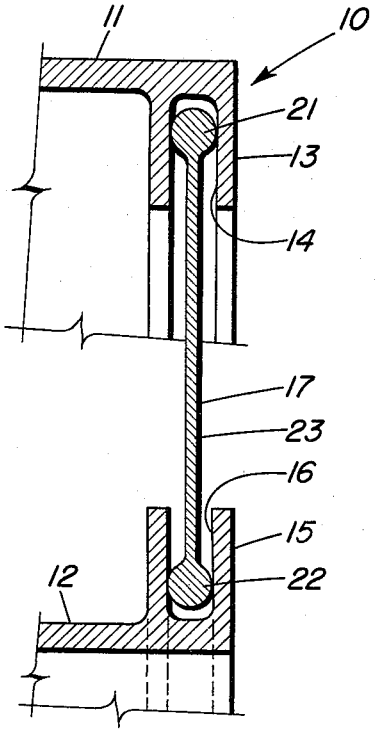
FIG. 3
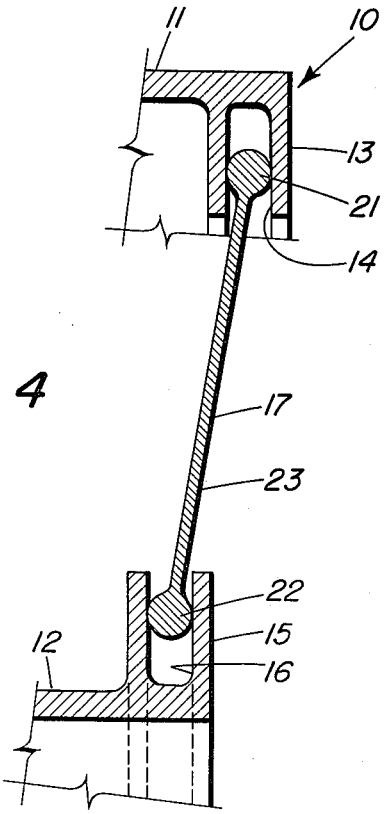
FIG. 4
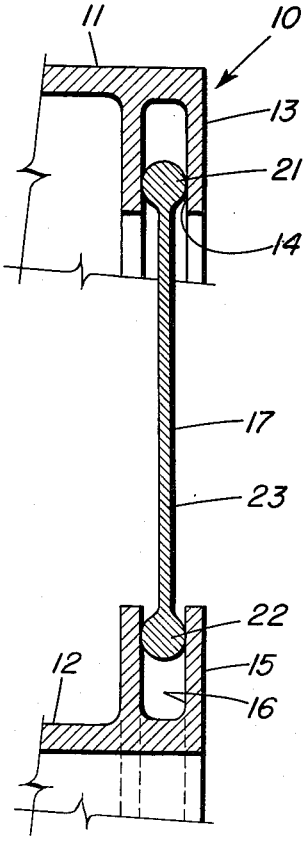
FIG. 5

TURBINE SEAL

BACKGROUND OF THE INVENTION

In the design of gas turbines a number of contradictory factors render a perfect design difficult to accomplish. For instance, one often encounters concentric tubular walls which are subjected to gases of extremely different temperature, so that expansion and contraction takes place, particularly when the turbine is brought from a cold condition to a hot operating condition. Thus, the different rates of expansion and contraction bring about geometric relationships that change considerably and make it difficult to seal one section of the turbine from another to prevent leakage of gas between two portions of the turbine. These and other difficulties experienced with the prior art devices have been obviated in a novel manner by the present invention.

It is, therefore, an outstanding object of the invention to provide a turbine seal capable of preventing leakage despite extreme differences in expansion and contraction of adjacent turbine elements.

Another object of this invention is the provision of a seal between concentric tubular elements of a turbine, which seal extends radially and is capable of good sealing despite axial and radial changes in the distance between the elements.

A further object of the present invention is the provision of a sealing system for use in a turbine, which system is simple, which is inexpensive to manufacture, and which is capable of a long life of useful service with a minimum of maintenance.

It is another object of the instant invention to provide a turbine seal which functions well and which is not destroyed by exposure to high-temperature gases.

With these and other objects in view, as will be apparent to those skilled in the art, the invention resides in the combination of parts set forth in the specification and covered by the claims appended hereto.

SUMMARY OF THE INVENTION

In general, the present invention consists of a turbine seal for use between two concentric tubular portions of the turbine. A ring is associated with the outer tubular element and has an inwardly-directed groove, while a second ring is associated with the inner tubular element and has an outwardly-directed groove. A junction element is provided in the form of a washer having an outer peripheral edge lying in the inwardly-directed groove and an inner peripheral edge lying in the outwardly-directed groove. Each groove is provided with spaced, parallel radial surfaces and the particular edge of the junction element that lies in each groove has an annular enlargement that fits snugly between the two parallel surfaces of the particular groove.

More specifically, the enlargement on the outer edge of the junction element is joined to the enlargement of the inner edge of the junction element by a thin-walled web. The junction element is formed of a metal that permits axial displacement between the two enlargements.

BRIEF DESCRIPTION OF THE DRAWINGS

The character of the invention, however, may be best understood by reference to one of its structural forms, as illustrated by the accompanying drawings, in which:

FIG. 2 is a perspective view of a portion of the turbine seal, and FIGS. 3, 4, and 5, are enlarged sectional views of the seal under three different conditions.

DESCRIPTION OF THE PREFERRED EMBODIMENT

Figure 1:
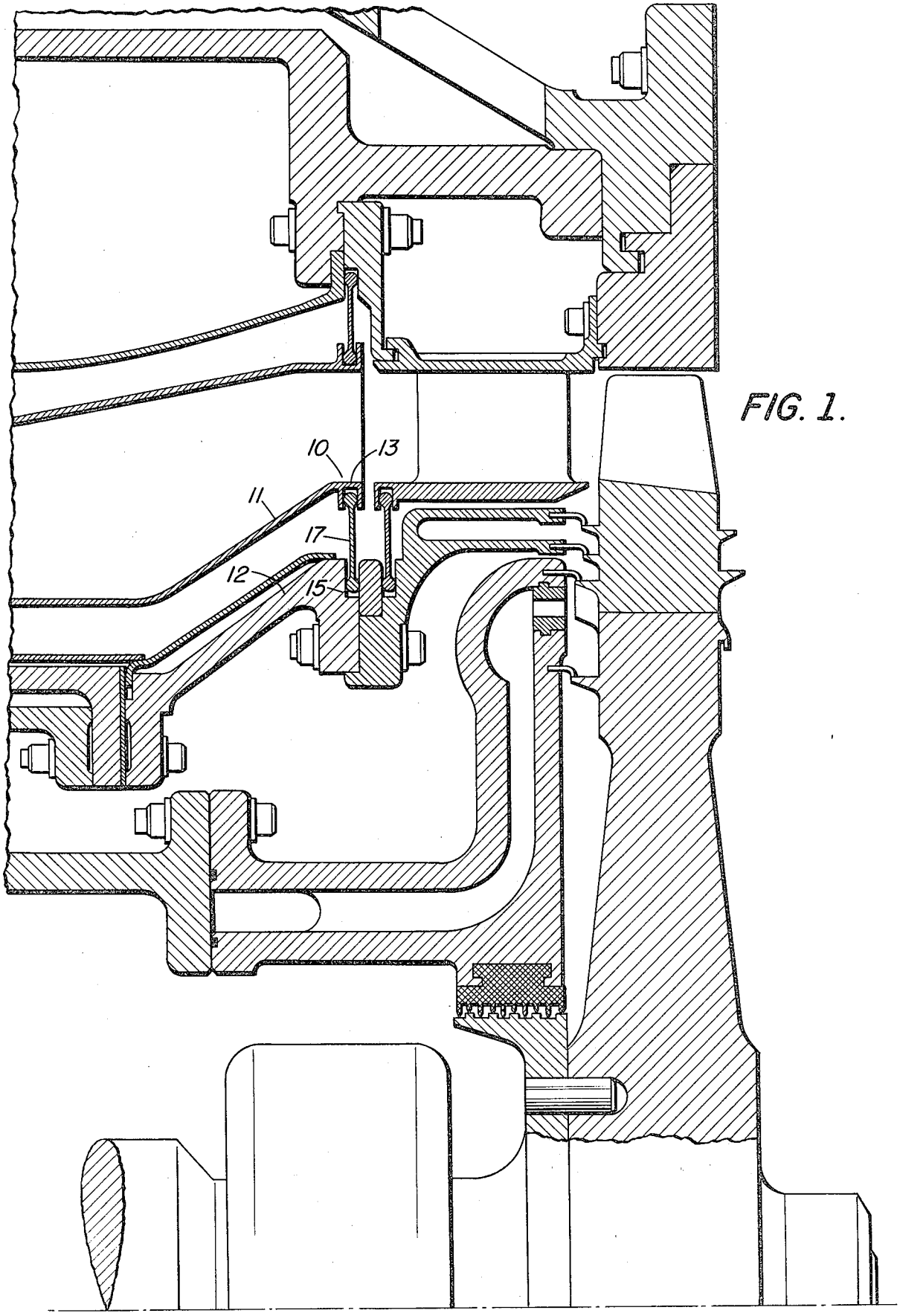
FIG. 1 is a vertical sectional view of a gas turbine showing the seal constructed in accordance with the principles of the present invention.

Referring first to FIG. 1, wherein are best shown the general features of the invention, it can be seen that the turbine seal, indicated generally by the reference numeral 10, is associated with an outer tubular element 11 and an inner tubular element 12. In the preferred embodiment, the outer tubular element 11 forms a boundary for the passage in which pass the hot gases from a combustor flowing to the rotary wheel of the turbine, while the inner tubular element 12 forms a barrier for cooling air passing to the center of that same wheel. These inner and outer elements are, therefore, subjected to gases of extremely different temperature. A first ring 13 is associated with the end of the first tubular element 11 closest adjacent the turbine wheel. This ring is provided with an inwardly-directed annular groove 14. A second ring 15 is associated with the adjacent end of the inner tubular element 12 and is provided with an outwardly-facing annular groove 16. The two grooves 14 and 16 are generally located in the same radial plane when the elements are cold. A junction element 17 in the form of a washer lies between the rings; it has an outer peripheral edge 18 which lies in the inwardly-directed groove 14 and an inner peripheral edge 19 which lies in the outwardly-directed groove 16 of the ring 15.

FIG. 2 is a perspective view of the junction element 17, showing that the outer edge 18 is provided with an enlargement 21, while the inner edge 19 is provided with an enlargement 22. All of the enlargements are in the form of an annuli with circular cross-sections.

As is evident in FIG. 3, the enlargement 21 lies between parallel, straight radial surfaces of the groove 14, while the enlargement 22 lies between similar straight radial spaced parallel surfaces of the groove 16. From the drawing it is clear that the distance between the parallel surfaces of the notch 15 are the same as the minor diameter of the annular enlargement 21, so that the enlargement fits snugly in the groove 14. Similarly, the distance between the spaced parallel radial surfaces of the groove 15 is the same as the diameter of the enlargement 22, so that the enlargement 22 fits snugly in the groove 16. In the preferred embodiment, the enlargement 21 and 22 have the same minor diameters, although they have distinctly different major diameters, of course. The enlargement 21 is joined to the enlargement 22 by a thin-walled web 23. The junction element 17 is formed of a metal such as beryllium copper that has a spring-like quality that will permit the enlargement 21 to be axially displaced from the enlargement 22 on occasion without breakage. The depths or radial extents of the grooves 14 and 16 are at least a distance as great as a diameter of their respective enlargement 21 and 22. The distance from the enlargement 21 and 22 to each other, i.e., the radial width of the web 23 is several times the minor diameter of the annular enlargement 21 and 22.

The manner of operation and the advantages of the present invention will now be readily understood in view of the above description, particularly in the light of FIGS. 4 and 5. While the turbine is operating, the hot gases from the combustor pass over the outer surface of the first outer tubular element 11, while cooling gases in the form of cool air are drawn into the turbine and pass over the inner surface of the inner tubular element 12. The elements 11 and 12 are, therefore, subjected to extremely different temperatures. These elements are cold before the turbine starts up and the grooves 14 and 16 lie exactly opposite one another (in the same general radial plane), so that the junction element 17 lies perfectly straight with its web 23 extending radially. At that time, the enlargement 21 lies in a mid-point (radially speaking) of the groove 14, while the enlargement 22 lies in a similar mid-point of the groove 16. When the outer and inner tubular elements 11 and 12 are subjected to hot and cool gas, respectively, they expand by two different amounts. In other words, they expand axially and they expand radially, but in different amounts. Pure axial growing of displacement places the elements in the condition shown in FIG. 4. That is to say, the outer element 11 expands to the right and carries the ring 13 with its groove 14 with it, while the inner tubular element 12 strays somewhat in in the cold condition. Thus, the enlargement 21 is displaced axially from the enlargement 22 and the web 23 occupies an angular position to the radial plane in which it originated when the turbine was cold. In FIG. 5, the condition is shown in which the outer tubular element 11 expands purely radially a greater amount than the inner tubular element 12, so that the distance between them becomes greater. In that case, the enlargements 21 and 22 slide down their grooves 14 and 16, respectively. Of course, they remain within the groove, since the grooves are designed with a great enough steps to permit this, but they do approach closer the entrances to the grooves. At the same time that this is happening, a certain degree of gas pressure presses to the right on the web 23 and holds the enlargements 21 and 22 against the straight surfaces of their respective grooves 14 and 16, so that leakage of gas does not take place. In other words, the enlargements 21 and 22 reside in various parts of their grooves, depending on the relative temperature of the outer and inner tubular elements 11 and 12. Of course, on occasion the enlargements 21 and 22 occupy relatively different radial positions; that is to say, they are spaced axially from one another, but the flexibility of the web 23 allows this without damage to the junction element 17 itself.

It can be seen, then, that the rings and their grooves, as well as the junction element 17, are relatively simple and rugged, so that the seal can operate over extremely long periods of time with a minimum of damage to themselves. Any wear on the enlargement itself, or on the radial surface of the groove, is compensated for by gas pressure against the relatively large web 23. Contact between the annular enlargements 21 and 22 and the respective straight radial surfaces of their respective grooves is in the nature of straight line contact, producing high unit pressure and, therefore, excellent sealing.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Turbine seal, comprising:

(a) an outer tubular element, (b) an inner tubular element, the elements being concentric and radially spaced, (c) a first ring joined to the outer tubular element, the ring having an inwardly-directed groove, (d) a second ring joined to the inner tubular element, the ring having an outwardly-directed groove, each groove of the first and second rings being with spaced, parallel radial surfaces, and (e) a junction element in the form of a washer having an outer peripheral edge lying in the inwardly-directed groove and an inner peripheral edge lying in the outwardly-directed groove, the edge of the junction element lying in each groove having an annular enlargement of circular cross-section that fits snugly between the radial surfaces, the grooves in the first and second rings having a depth in the radial direction that is at least greater than the minor diameter of the enlargement.

2. Turbine seal as recited in claim 1, wherein the enlargement at the outer edge of the junction elements is joined to the enlargement at the inner edge by a thin-walled web, and wherein the junction element is formed of a metal permitting limited axial displacement between the two enlargements without damage.

3. Turbine seal as recited in claim 2, wherein the radial width of the web is several times the minor diameter of the enlargement, and wherein the said minor diameter of the outer edge enlargement is the same as that of the inner edge enlargement.

* * * * *